US008256023B2

(12) United States Patent
Park et al.

(10) Patent No.: US 8,256,023 B2
(45) Date of Patent: Sep. 4, 2012

(54) COVERALL CONVENIENT TO ACT

(76) Inventors: Nam Kyu Park, Geoje-si (KR); Young Soo Lee, Geoje-si (KR)

( * ) Notice: Subject to any disclaimer, the term of this patent is extended or adjusted under 35 U.S.C. 154(b) by 197 days.

(21) Appl. No.: 12/734,499

(22) PCT Filed: Nov. 10, 2008

(86) PCT No.: PCT/KR2008/006621

§ 371 (c)(1),
(2), (4) Date: Aug. 25, 2010

(87) PCT Pub. No.: WO2009/064094

PCT Pub. Date: May 22, 2009

(65) Prior Publication Data

US 2010/0313324 A1 Dec. 16, 2010

(30) Foreign Application Priority Data

Nov. 15, 2007 (KR) ..... 20-2007-0018429 U

(51) Int. Cl.
*A41D 27/20* (2006.01)
*A41D 13/02* (2006.01)
*A41D 27/00* (2006.01)

(52) U.S. Cl. ..... 2/79; 2/69; 2/247; 2/251; 2/275

(58) Field of Classification Search ..... None
See application file for complete search history.

(56) References Cited

U.S. PATENT DOCUMENTS 4,607,396 A * 8/1986 Craig ..... 2/79
4,670,913 A * 6/1987 Morell et al. ..... 2/227
4,718,122 A * 1/1988 Steverson ..... 2/70
5,473,780 A * 12/1995 Zen ..... 2/79
5,790,984 A * 8/1998 Doubleday ..... 2/69
5,829,059 A * 11/1998 Covington, Jr. ..... 2/79
6,477,711 B1 * 11/2002 Freeman et al. ..... 2/69
6,735,789 B2 * 5/2004 Kelleher et al. ..... 2/458
6,839,909 B1 * 1/2005 Prince ..... 2/81
7,146,646 B2 * 12/2006 Grilliot et al. ..... 2/93
7,181,774 B2 * 2/2007 Silver ..... 2/227
D588,337 S * 3/2009 Van Alstine et al. ..... D2/743
7,966,669 B1 * 6/2011 Siepmann ..... 2/123
7,971,283 B2 * 7/2011 Winterhalter et al. ..... 2/456
2002/0016985 A1 * 2/2002 Kelleher et al. ..... 2/458

(Continued)

FOREIGN PATENT DOCUMENTS

JP 54110317 8/1979

(Continued)

*Primary Examiner* — Bobby Muromoto, Jr.
(74) *Attorney, Agent, or Firm* — Cooper & Dunham LLP

(57) ABSTRACT

A coverall is convenient for a worker to act, and can be easily distinguished at night, with a convenience for a worker in doing a job. The coverall includes an upper clothes part, waist part and lower clothes part. The coverall has a shape wrapping an upper body of worker, and the upper and lower clothes parts are united through the waist part. The upper clothes part includes a wear fastener part, front-face protective cover, back fold part formed folded on the right and left both sides of the back surface, and a luminous band. The waist part has a waist band with elasticity. The lower clothes part is coupled to the upper clothes part in a united type with the waist part, and includes a lower clothes opening part openable along a hip part of worker on a rear face, a dual pocket, and a luminous band. The lower clothes opening part is formed in a "∪" or "∩" shape.

10 Claims, 4 Drawing Sheets

30 : 31,32,33

U.S. PATENT DOCUMENTS

| | | | | |
|---|---|---|---|---|
| 2004/0107473 | A1* | 6/2004 | Jones et al. | 2/69 |
| 2004/0148685 | A1* | 8/2004 | Messinger | 2/455 |
| 2004/0199980 | A1* | 10/2004 | Silver | 2/227 |
| 2004/0199984 | A1* | 10/2004 | Bassick et al. | 2/468 |
| 2004/0250331 | A1* | 12/2004 | Bayer | 2/69 |
| 2006/0040575 | A1* | 2/2006 | Kelleher et al. | 442/73 |
| 2006/0064797 | A1* | 3/2006 | Pyeatt Rowe et al. | 2/244 |
| 2006/0107434 | A1* | 5/2006 | Rowe et al. | 2/69 |
| 2006/0195963 | A1* | 9/2006 | Grilliot et al. | 2/81 |
| 2007/0094763 | A1* | 5/2007 | Silver | 2/69 |
| 2007/0226868 | A1* | 10/2007 | Hunt | 2/69 |
| 2008/0134407 | A1* | 6/2008 | Winterhalter et al. | 2/79 |
| 2008/0216218 | A1* | 9/2008 | McKinney et al. | 2/457 |
| 2008/0250553 | A1* | 10/2008 | Gatto et al. | 2/457 |
| 2008/0301861 | A1* | 12/2008 | Meistrell et al. | 2/458 |
| 2009/0300833 | A1* | 12/2009 | Kampert et al. | 2/458 |
| 2010/0024103 | A1* | 2/2010 | Kelleher et al. | 2/458 |
| 2010/0031427 | A1* | 2/2010 | Smith et al. | 2/456 |
| 2010/0132089 | A1* | 6/2010 | Myers | 2/79 |
| 2010/0146686 | A1* | 6/2010 | Winterhalter et al. | 2/458 |

FOREIGN PATENT DOCUMENTS

| | | |
|---|---|---|
| JP | 3056120 | 11/1998 |
| JP | 2006161255 | 6/2006 |
| KR | 200248690 | 9/2001 |

* cited by examiner

[Fig. 1]
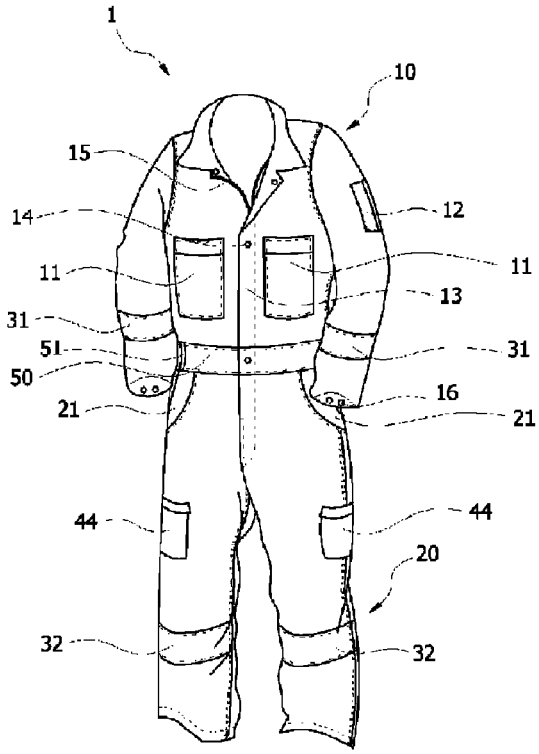
30 : 31,32,33
[Fig. 2]
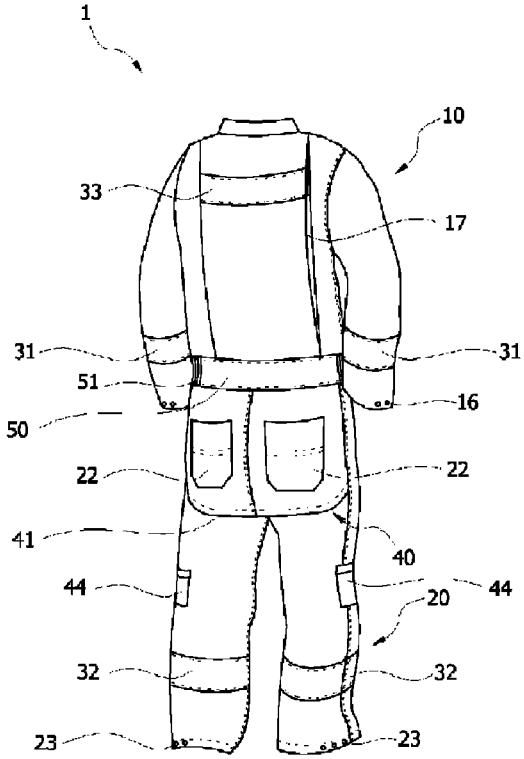

[Fig. 3]
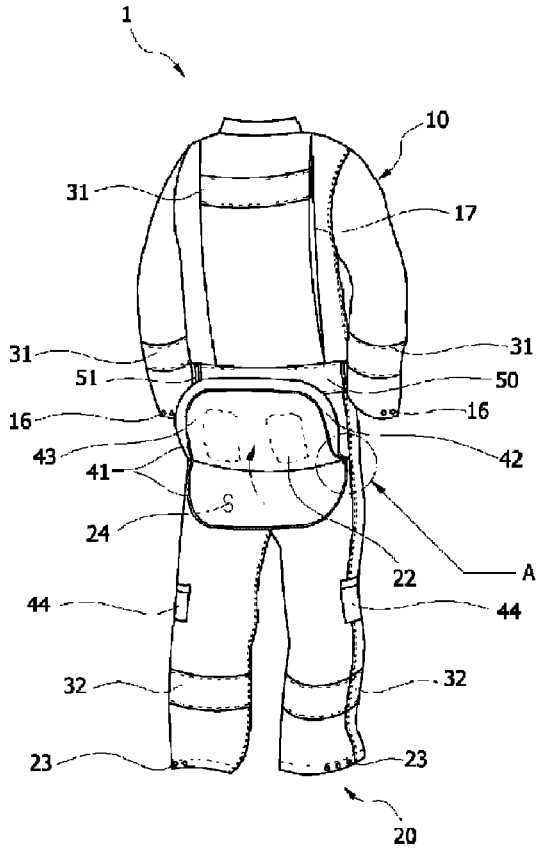
[Fig. 4]
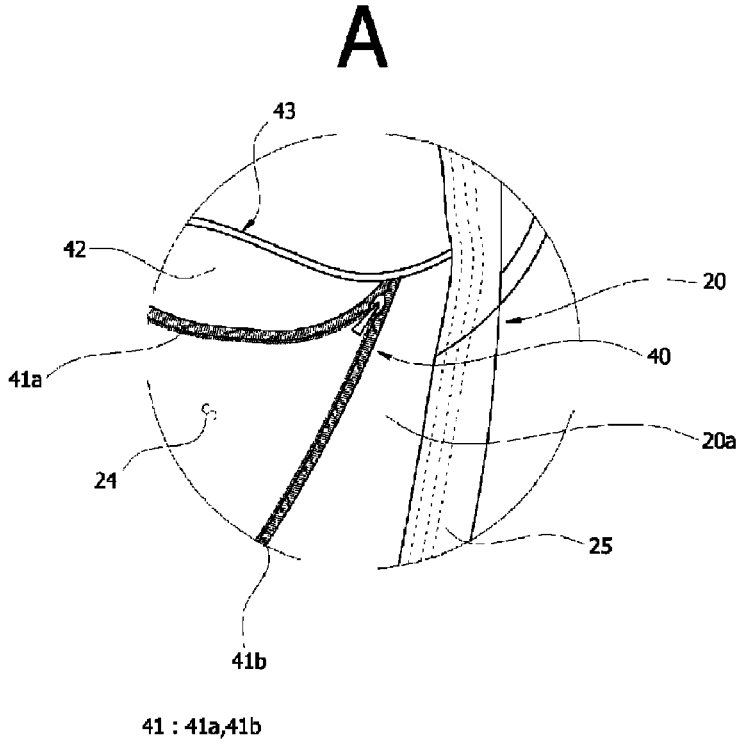

[Fig. 5]
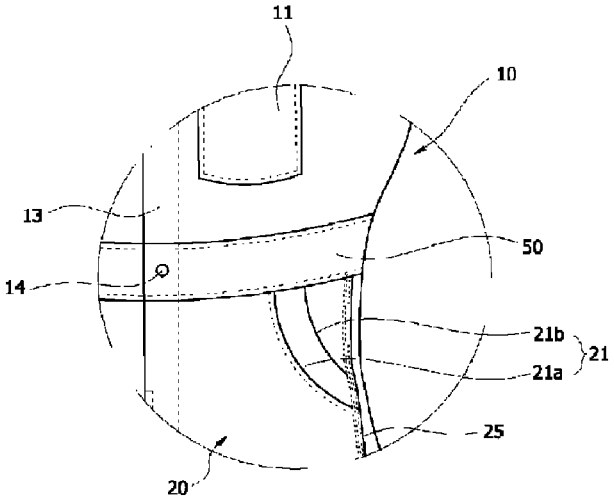
[Fig. 6]
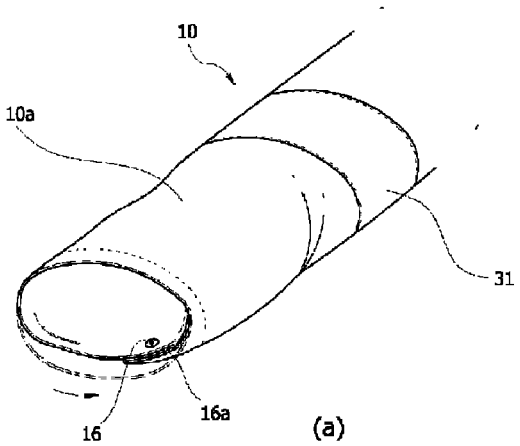
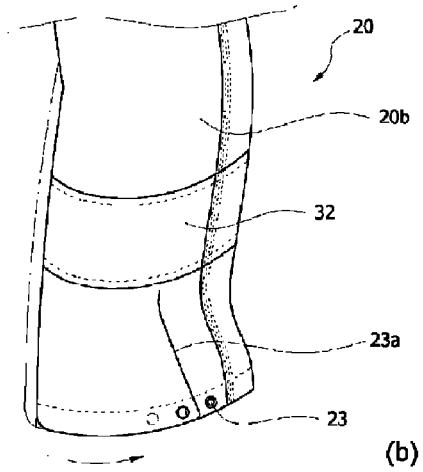

[Fig. 7]
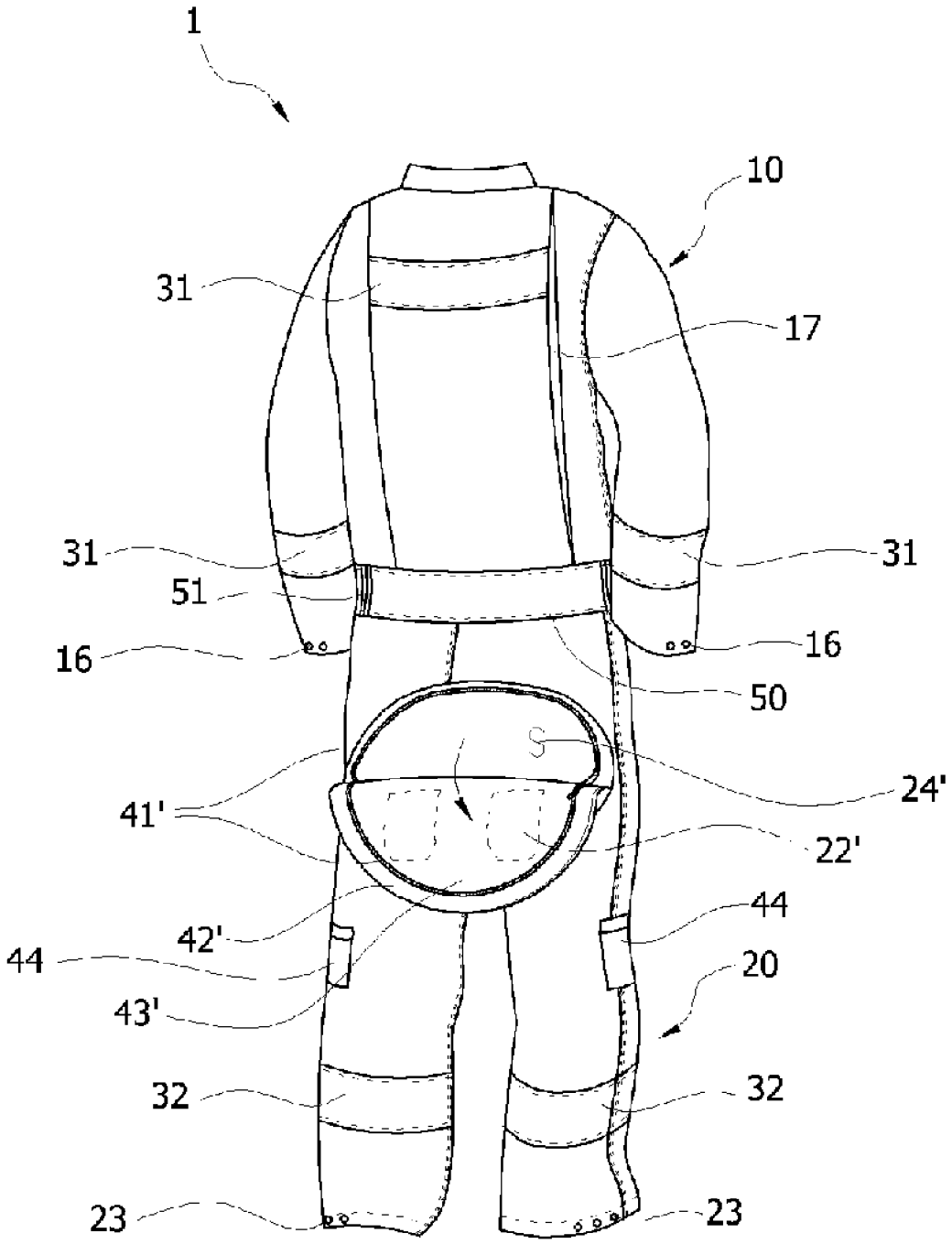

COVERALL CONVENIENT TO ACT

TECHNICAL FIELD

The present invention relates to a coverall, and more particularly, to a coverall convenient for a worker to act, which is capable of being easily distinguished at night and being convenient for a worker in doing a job.

BACKGROUND ART

In general working clothes may be classified as types of upper/lower separated clothes and upper/lower integrated clothes. Here, the upper/lower integrated working clothes may be called a coverall type working clothes, that is, generally an upper/lower integrated working clothes with sleeves different from its similar overall type working clothes.

Such coveralls are worn by workers in the environments such as factories, car centers, etc. to get a basic function of protecting the body of workers and functions of preventing various kinds of pollution materials such as oil, metal powder etc. from directly touching the skin of workers.

Further, such coveralls can exclude an inflow of paint or dusts into the body in a painting work or work in the environment of much dust, thus preventing the body from being stained. As the clothes is an upper/lower one-body type, it can be prevented that a portion of working clothes worn by a worker is caught by working equipment such as an operating machine or protrusions etc., thereby safely protecting workers.

There may be cases that workers wear general other clothes inside the coveralls, and at this time, such underclothes may be protected and the body can be protected from accidents during working.

However, the use of such general coveralls may be cause many limitations in the activity of workers and much working time loss because a worker must first open an upper clothes part and take off the coverall's coupled lower clothes part when the worker needs to perform acts such as excretion of bodily waste. With general coveralls, the worker must subsequently remove shoes so as to prevent the shoes from being caught inside leg parts of the lower clothes part and then expose his/her entire posterior so that he/she can take the necessary action.

Furthermore, when a worker wears an integrated type working clothes in addition to underclothes, such underclothes may disadvantageously shift or ride up inside of the working clothes during working. At this time, to arrange the underclothes neatly, the working clothes should be first taken off, much as the worker might do when excreting wastes as described above, and then the worker can arrange neatly the underclothes, but only through such inconvenience.

Furthermore, a general coverall makes so much of a body protecting function that the activity of workers becomes inconvenient owing to being stuck tightly to the working clothes in the back, wrist and ankle parts with relatively many motions.

Generally in night work, together with the coveralls the workers wear a band such as a luminous X-band wearable over the working clothes or specifically wear a protective clothing of a luminous vest type to which a reflection film is stuck to the back surface of the vest, over the working clothes, thereby ensuring the safety. However, the worker may feel an inconvenience in the activity when wearing another clothing over the working clothes, causing very low work efficiency.

DISCLOSURE OF INVENTION

Technical Problem

Accordingly, there is a need to provide a coverall being capable of partially separating a lower clothes part of the coverall from an upper clothes part by using a lower clothes opening part, and having a dual pocket formed piercing the lower clothes part, thereby providing a convenience to be easy in the work activity.

Furthermore, there is a need to provide a coverall with a back fold part formed vertically long in the back part of the upper clothes part and with a margin space to prevent the working clothes from being pulled or tightened to the body by using a snap adapted in the wrist part and the ankle part, thereby providing a convenience in the work activity.

Furthermore, there is a need to provide a coverall being capable of making easy in the activity of worker and being seen and recognized even in a difficult status to distinguish objects due to a peripheral low illumination by forming a plurality of luminous bands in one side of the upper and lower clothes parts of the working clothes, thereby keeping a safety of worker and increasing a working efficiency.

Technical Solution

According to an embodiment of the invention, a coverall convenient for a worker to act comprises an upper clothes part having a shape wrapping an upper body of the worker, the upper clothes part being provided with a wear fastener part formed from a neck side to a trouser leg side in a vertical direction on a front center part thereof, a front-face protective cover formed in the size enough to cover the wear fastener part and provided with a plurality of wear snaps arranged in one side thereof, a back fold part formed folded vertically from a shoulder side to a waist side on the right and left both sides of the back surface, and at least one luminous band arranged in one side thereof; a waist part extended united with the upper clothes part and provided with a waist band having an elasticity in one side thereof; and a lower clothes part coupled to the upper clothes part in an integrated type with the waist part and formed in a shape wrapping the lower body of the worker, the lower clothes part including a lower-clothes opening part formed cut along a hip shape of the worker to be folded and opened on a rear face thereof, a dual pocket formed of a first pocket with an internal space in a side face and a second pocket formed piercing a side face, and at least one luminous band arranged in one side thereof, the lower-clothes opening part including an opening-part fabric formed cut to be folded to have a "∪" shape from a side upper part into a downward direction along the hip shape of the worker, an open fastener part formed along an edge part of the opening-part fabric and the cut portion of the lower clothes part, and an open protective cover formed extended from an edge part of the opening-part fabric in the size enough to cover the open fastener part, so as to raise the opening-part fabric into an upward direction and to open.

According to another embodiment of the invention, a coverall convenient for a worker to act comprises an upper clothes part having a shape wrapping an upper body of the worker, the upper clothes part being provided with a wear fastener part formed from a neck side to a trouser leg side in a vertical direction on a front center part thereof, a front-face protective cover formed in the size enough to cover the wear fastener part and provided with a plurality of wear snaps arranged in one side thereof, a back fold part formed folded vertically from a shoulder side to a waist side on the right and left both sides of the back surface, and at least one luminous band arranged in one side thereof; a waist part extended united with the upper clothes part and provided with a waist band having an elasticity in one side thereof; and a lower clothes part coupled to the upper clothes part in an integrated type with the waist part and formed in a shape wrapping the lower body of the worker, the lower clothes part including a lower-clothes opening part formed cut along a hip shape of the worker to be folded and opened on a back face thereof, a dual pocket formed of a first pocket with an internal space in a side face and a second pocket formed piercing a side face, and at least one luminous band arranged in one side thereof, the lower-clothes opening part including an opening-part fabric formed cut to be folded to have a "∩" shape from a side lower part into an upward direction along the hip shape of the worker, an open fastener part formed along an edge part of the opening-part fabric and the cut portion of the lower clothes part, and an open protective cover formed extended from an edge part of the opening-part fabric in the size enough to cover the open fastener part, so as to drop the opening-part fabric into a downward direction.

On the other hand, according to an embodiment of the invention, the coverall may further comprise a fixation snap with attached/detached buttons on a corresponding position of the working clothes when one end part of the opening-part fabric of the lower-clothes opening part and the opening part fabric are opened, the fixation snap being to fix a position of the opening part fabric.

In addition, the upper clothes part may further comprise a wrist snap and an ankle snap provided with an end part of wrist side of the upper clothes part and an end part of ankle side of the lower clothes part to individually control a width thereof.

The luminous band may be comprised of a back luminous band transversely coupled between the back fold parts arranged on both sides of back face of the upper clothes part, an arm luminous band formed wound round one side of both arms, and a leg luminous band formed wound round one side of both legs.

The upper clothes part may further comprise chest pockets adapted in the right and left sides of the front face, the chest pockets having an internal space and being openable by a fastener, and a pen pocket adapted on an upper arm side, the pen pocket having two divided internal spaces into which writing materials can be inserted.

The lower clothes part may further comprise lower-clothes pockets formed in the left and right sides of the opening part fabric of the lower clothes opening part, the lower-clothes pockets having an internal space.

Advantageous Effects

As described above, in a coverall according to some embodiments of the invention, female or male workers can easily do a job through a lower clothes opening part formed on a hip portion of the clothes even without taking off overall the coverall, thereby substantially reducing a working time consumption with a very easy activity effect.

A convenience of the activity can be ensured by preventing an upper clothes part from being tightened to the body through use of a back fold part of the upper clothes part, and foreign materials can be prevented from invading into an opened wrist part or ankle part by controlling the size of end part of the coverall through use of width control snap of wrist and ankle parts.

Further, underclothes can be neatly arranged without taking off the coverall by using a second pocket formed piercing of a dual pocket formed in one side of the lower clothes part and a ventilation and the activity is easy to get.

In addition it is easy to distinguish workers even at night work through a plurality of luminous bands adapted on wrist and ankle sides and the back, thereby ensuring the safety of worker and increasing a working efficiency.

BRIEF DESCRIPTION OF THE DRAWINGS

FIG. 1 is a front perspective view illustrating a coverall convenient to act according to an embodiment of the invention;

FIG. 2 is a back perspective view illustrating a coverall convenient to act according to an embodiment of the invention;

FIG. 3 is a back perspective view illustrating a lower clothes opening part of a coverall convenient to act according to an embodiment of the invention;

FIG. 4 is an enlarged view of FIG. 3;

FIG. 5 is an enlarged view illustrating a dual pocket of a coverall convenient to act according to an embodiment of the invention;

FIG. 6 illustrates a control snap of a coverall convenient to act according to an embodiment of the invention; and FIG. 7 is a back perspective view illustrating a lower clothes opening part of a coverall convenient to act according to another embodiment of the invention.

MODE FOR THE INVENTION

A coverall convenient for a worker to act are described as follows with reference to the accompanied drawings according to some embodiments of the invention.

FIG. 1 is a front perspective view illustrating a coverall convenient to act according to an embodiment of the invention. FIG. 2 is a back perspective view illustrating a coverall convenient to act according to an embodiment of the invention. FIG. 3 is a back perspective view illustrating a lower clothes opening part of a coverall convenient to act according to an embodiment of the invention.

FIG. 4 is an enlarged view of FIG. 3. FIG. 5 is an enlarged view illustrating a dual pocket of a coverall convenient to act according to an embodiment of the invention. FIG. 6 illustrates a control snap of a coverall convenient to act according to an embodiment of the invention.

As shown in the drawings, a coverall 1 according to an embodiment of the invention is formed in one-piece type that upper and lower clothes parts 10 and 20 are coupled in a united shape on a waist part 50, and has a shape of a human body enough to wrap the body of a worker.

Here the upper clothes part 10 has a shape wrapping the upper body of worker, and is provided with a wear fastener part 15 extended to one side of the lower clothes part 20 so that the worker is easy to put on and take off the coverall 1, and provided with a plurality of pockets and a plurality of luminous bands 30 adapted in one side thereof so as to be easy to distinguish the worker even at night.

The waist part 50 is formed extended from an end part of the upper clothes part 10 and formed in a united shape, and provided with a waist band 51 having an elasticity in one side thereof. When the worker wears the coverall 1, the worker can well put on the coverall 1, tightening the waist of the worker without loosening by using the waist band 51, thereby enhancing a wearing feeling of the worker in wearing the coverall 1.

The lower clothes part 20 is formed extended from an end part of the waist part 50 in an integrated shape, and coupled to the upper clothes part 10 through the waist part and has a shape wrapping the lower body of worker.

The lower clothes part 20 comprises a dual pocket 21 including a pocket formed piercing a lower clothes fabric, in a side face thereof, and a lower clothes opening part 40 formed openable by a fastener part, in a back face thereof. Further pluralities of luminous bands 30 are adapted in one side to distinguish a worker even at night.

On the other hand, on end parts of the upper and lower clothes parts 10 and 20, a snap formed of one pair of female button and male button attached and detached is adapted to control the width thereof. The snap is classified as a wrist snap 16 and an ankle snap 23.

The coverall 1 convenient to act is described more in detail referring to the drawings, as follows.

The coverall 1 convenient to act is formed in a united type of upper clothes part 10 and lower clothes part 20 including the waist part 50.

The upper clothes part 10 comprises a wear fastener part 15 formed from a neck side to a trouser leg side in a vertical direction on a front center part thereof, and a front-face protective cover formed in the size enough to cover the wear fastener part 15 and provided with a plurality of wear snaps 14 arranged in one side thereof.

Here, in the coverall, the leg side is adapted in the lower clothes part 20, and the wear fastener part 15 may be beneficially formed extended to the leg side of the lower clothes part 20. The front-face protective cover 13 is adapted in a shape completely covering the wear fastener part 15 when the coverall is seen from the outside. The front-face protective cover 13 is formed of the same fabric as fabric of the coverall 1, and one end thereof is sewn along the wear fastener part 15 from the upper clothes part 10 to the lower clothes part 20 to be united. The front-face protective cover 13 covers the wear fastener part 15, and wear snaps 14 are adapted along it with a given distance to be united with the coverall 1 through the use of wear snaps 14 in the work of worker.

The upper clothes part 10 comprises a back fold part 17 formed folded vertically from a shoulder side to a waist side on the right and left both sides of the back surface.

The back fold part 17 is provided as a folded part of fabric forming the upper clothes part 10. In a folded state of the fabric, both end parts, that is, portions of the fabric positioned on shoulder side and waist side are sewn, thereby forming the back fold part 17.

Worker wearing the coverall 1 according to an embodiment of the invention can be convenient to work by preventing a tightened effect of the coverall during working through use of the back fold part 17, thereby increasing a working efficiency.

The upper clothes part 10 comprises at least one luminous band 30 on one side thereof. The luminous band 30 may be largely classified as a back luminous band 33 of a straight type transversely coupled between both back fold parts 17 of back face of the upper clothes part 10, and an arm luminous band 31 formed wound round one side of both arms.

Such luminous band 30 can make a worker easily distinguished even at night, thus accidents can be prevented during working and the working efficiency can increase.

Further, the waist part 50 is adapted with a waist band 51 having an elasticity in one side. The waist band 51 may be beneficially obtained by forming a space inside fabric of the waist part and inserting a rubber band thereinto, thereby enhancing a wearing feeling of worker. The waist band 51 may be beneficial to form on both side faces of the coverall.

The lower clothes part 20 comprises a lower-clothes opening part 40 formed cut along a hip shape of the worker to be folded and opened on a rear face thereof, a dual pocket 21 formed on a side face, and at least one luminous band 30 arranged in one side thereof.

The lower clothes opening part 40 that is openable and is adapted in the lower clothes part 20, is described as follows, referring to FIGS. 3 and 4.

In an embodiment of the invention, the lower clothes opening part 40 is adapted to be raised upward to open. The lower-clothes opening part 40 comprises an opening-part fabric 43 provided as a portion of fabric forming the lower clothes part 20 and formed cut to be folded to have a "U" shape from a side upper part into a downward direction along a hip shape of the worker, an open fastener part 41 formed along an edge part of the opening-part fabric 43 and the cut portion of the lower clothes part 20, and an open protective cover 42 formed extended from an edge part of the opening-part fabric 43 in the size enough to cover the open fastener part 41.

Here the open fastener part 41 is formed so that a start side thereof becomes near a side line 25 of the lower clothes 20, and is classified as an upper fastener 41*a* formed together with the open protective cover 42 along the edge part of the opening part fabric 43, and a lower fastener 41*b* formed along a cut part of the opening part fabric 43 in the lower clothes part 20. The upper fastener 41*a* is engaged and united with the lower fastener 41*b*.

In the lower clothes opening part 40, the opening part fabric 43 is opened by a shape of the open fastener part 41 and is raised upward to open a lower clothes inside 24.

As described above, in the coverall 1 convenient to act according to an embodiment of the invention, the lower clothes opening part 40 openable by a fastener according to a necessity is adapted in a rear face, accordingly, when a male or female worker does do a job in working, the worker can do a job by opening the open fastener part 41 and raising the opening part fabric 43 in an upward direction. That is, the worker can easily do a job without overall taking off the coverall 1.

When a ventilation of the coverall is needed in working, the lower clothes opening part 40 is opened during working, thus increasing a ventilation effect and performing relatively better work.

Though not shown in the drawings, the coverall 1 may further comprise a fixation snap (not shown) using mutual attached and detached buttons, the fixation snap being adapted on one side position of the coverall 1 corresponding when the one end part of the opening part fabric 43 of the lower clothes part 40 and the opening part fabric 43 are opened. Thus, when worker wants to do a job, a position of the opened opening part fabric 43 can be fixed.

That is, the fixation snap is comprised of one pair of female button and male button that are attached and detached from each other. The male button is adapted on one side end part of the opening part fabric 43, beneficially on the open protective cover 42. The female button may be adapted on one side position of the upper clothes part 10, waist part 50 and lower clothes part 20, the position corresponding to the size of the opening part fabric 43 provided when the opening part fabric 43 is opened. Thus the position of opening part fabric having opened can be fixed.

The lower clothes part 20 is provided with a dual pocket 21 formed piercing fabric of the lower clothes part in one side thereof.

More in detail, referring to FIG. 5, the dual pocket 21 of the lower clothes part 20 is classified as a first pocket 21*a* having an internal space on a side face, and a second pocket 21*b* formed piercing a side face to become near the first pocket 21*a*.

Here the second pocket 21*b* is called a through hole that has not an internal space and pierces a side face of the lower clothes part 20, and a worker having worn the coverall 1 can neatly arrange underclothes inside the coverall during working by using the second pocket 21*b* even without taking off the coverall, and a ventilation effect increases.

On the other hand, the dual pockets 21 are each adapted on both side faces of the lower clothes part 20, and the dual pocket 21 formed of fabric is got by sewing one end thereof with a lower part of the waist part 50 and sewing another end with one side line 25 of the lower clothes part, to produce an entrance through which a hand of worker can be inserted.

In the lower clothes part 20, at least one luminous band 30 is adapted on one side, and the luminous band 30 adapted in the lower clothes part 20 may be largely classified as leg luminous bands 32 adapted wound round one side of both legs of the lower clothes part 20.

Workers can be distinguished more easily at night through such luminous band 30, thus preventing accident in working and increasing a working efficiency.

Then, referring to FIGS. 1, 2 and 6, a wrist snap 16 to control the width is further formed in an end part of wrist side of the upper clothes part 10, and an ankle snap 23 to control the width is further formed on an end part of ankle side of the lower clothes part 20.

More in detail, with reference to (a) of FIG. 6, an arm luminous band 31 is adapted wound round one side of an arm fabric 10*a* of the upper clothes part 10 to be distinguished at night, and a wrist snap 16 is adapted on an end side of the arm fabric 10*a*.

The wrist snap 16 may be applied in several numbers with a uniform distance when necessary. Here a male button of the wrist snap 26 is one and female buttons may be provided in several numbers, to control the width through a detachment/detachment operation of the buttons.

The worker may control the width matching to his/her own wrist size by using the wrist snap 16, enhancing a wearing feeling. The arm fabric 10*a* produces a folded line 16*a* when reducing the width through use of the wrist snap 16.

Referring to (b) of FIG. 6, a leg luminous band 32 is adapted wound round one side of leg fabric 20*a* of the lower clothes part 20 to be easily distinguished at night, and the ankle snap 23 is adapted on an end side of the leg fabric 20*a*.

According to a necessity, the ankle snap 23 may be adapted in plural number with a uniform distance. Here a male button of the ankle snap 23 is one and female buttons are several, and the width can be controlled by their attachment and detachment.

On the other hand, referring again to FIGS. 1 to 3, the coverall 1 convenient to act comprises a plurality of pockets to increase a use convenience.

Here the upper clothes part 10 comprises chest pockets 11 adapted in the right and left sides of the front face, the chest pockets 11 having an internal space and being openable by a fastener, and a pen pocket 12 adapted on an upper arm side, the pen pocket 12 having two divided internal spaces into which writing materials can be inserted.

The lower clothes part 20 comprises two lower-clothes pockets 22 formed in the left and right sides of the opening part fabric 43 of the lower clothes opening part 40 on a rear face thereof, including the dual pocket 21 described above, the lower-clothes pockets 22 having an internal space.

FIG. 7 is a back perspective view illustrating a lower clothes opening part of a coverall convenient to act according to another embodiment of the invention.

As described above, a lower clothes opening part 40' adapted in the lower clothes part 20 of the coverall 1 convenient to act may have an opposite open direction for a convenience of worker according to an embodiment of the invention.

In another embodiment of the invention, the lower clothes opening part 40' adapted to drop an opening part fabric 43' into a downward direction. The lower-clothes opening part 40' comprises an opening-part fabric 43' as a portion of fabric forming the lower clothes part 20, formed cut to be folded to have a "∩" shape from a side lower part into an upward direction along a hip shape of worker, an open fastener part 41' formed along an edge part of the opening-part fabric 43' and the cut portion of the lower clothes part 20, and an open protective cover 42 formed extended from an edge part of the opening-part fabric 43' in the size enough to cover the open fastener part 41.

In the lower clothes opening part 40', the opening part fabric 43' is opened in a type dropped into a downward direction matching to a shape of the open fastener part 41', and thus a lower clothes inside 24' is opened and seen.

Therefore, worker can easily do a job without taking off overall the coverall 1.

On the other hand, thought not shown in the drawings, the coverall may further comprise a fixation snap (not shown) with attach and detach buttons on one-side corresponding position of the coverall 1 when one end part of the opening-part fabric 43' of the lower-clothes opening part 40' and the opening part fabric 43' are opened. That is, the position of the opened-opening part fabric 43' can be fixed through use of the fixation snaps when the worker wants to do a job.

That is, the fixation snap is an attached/detached button formed of one pair of female button and male button. When the mail button is adapted on one side end part of the opening part fabric 43' beneficially on the open protective cover 42', and the female button is adapted on one side position of the lower clothes part 20 corresponding when the opening part fabric 43' is opened; the position of the opening part fabric can be fixed.

A cracker pocket 44 with an internal space may be formed in both side faces of a leg in the lower clothes part 20 according to a necessity.

As described above, in a coverall according to some embodiments of the invention, female or male workers can easily do a job through a lower clothes opening part formed on a hip portion of the clothes even without taking off overall the coverall, thereby substantially reducing a working time consumption with a very easy activity effect.

A convenience of the activity can be ensured by preventing an upper clothes part from being tightened to the body through use of a back fold part of the upper clothes part, and foreign materials can be prevented from invading into an opened wrist part or ankle part by controlling the size of end part of the coverall through use of width control snap of wrist and ankle parts.

While the present invention has been particularly shown and described with reference to exemplary embodiments thereof, it will be understood by those skilled in the art that various changes in form and details may be made therein without departing from the spirit and scope of the present invention as defined by the appended claims. Accordingly, these and other changes and modifications are seen to be within the true spirit and scope of the invention as defined by the appended claims.

The invention claimed is:

1. An coverall convenient for a worker to act, comprising:

an upper clothes part having a shape wrapping an upper body of the worker, the upper clothes part being provided with a wear fastener part formed from a neck side to a trouser leg side in a vertical direction on a front center part thereof, a front-face protective cover formed in a size sufficient to cover the wear fastener part and provided with a plurality of wear snaps arranged in one side thereof, a back fold part formed folded vertically from a shoulder side to a waist side on right and left both sides of back surface, and at least one luminous band arranged in one side thereof;

a waist part extended united with the upper clothes part and provided with a waist band having an elasticity in one side thereof; and a lower clothes part coupled to the upper clothes part in an integrated type with the waist part and formed in a shape wrapping a lower body of the worker, the lower clothes part including a lower-clothes opening part formed to be openable folded and on a back face thereof, a dual pocket formed of a first pocket with an internal space in a side face and a second pocket formed piercing a side face, and at least one luminous band arranged in one side thereof, wherein the lower-clothes opening part including an opening-part fabric formed cut to be folded to have a "U" shape from a side upper part into a downward direction along a hip shape of the worker, an open fastener part formed along an edge part of the opening-part fabric and the cut portion of the lower clothes part, and an open protective cover formed extended from an edge part of the opening-part fabric in the size enough to cover the open fastener part, so as to raise the opening-part fabric into an upward direction and to open.

2. An coverall convenient for a worker to act, comprising:

an upper clothes part having a shape wrapping an upper body of the worker, the upper clothes part being provided with a wear fastener part formed from a neck side to a trouser leg side in a vertical direction on a front center part thereof, a front-face protective cover formed in a size sufficient to cover the wear fastener part and provided with a plurality of wear snaps arranged in one side thereof, a back fold part formed folded vertically from a shoulder side to a waist side on right and left both sides of a back surface, and at least one luminous band arranged in one side thereof;

a waist part extended united with the upper clothes part and provided with a waist band having an elasticity in one side thereof; and a lower clothes part coupled to the upper clothes part in an integrated type with the waist part and formed in a shape wrapping a lower body of the worker, the lower clothes part including a lower-clothes opening part formed cut along a hip shape of the worker to be folded and opened on a back face thereof, a dual pocket formed of a first pocket with an internal space in a side face and a second pocket formed piercing a side face, and at least one luminous band arranged in one side thereof, the lower-clothes opening part including an opening-part fabric formed cut to be folded to have a "n" shape from a side lower part into an upward direction along the hip shape of the worker, an open fastener part formed along an edge part of the opening-part fabric and the cut portion of the lower clothes part, and an open protective cover formed extended from an edge part of the opening-part fabric in the size enough to cover the open fastener part, so as to drop the opening-part fabric into a downward direction and to open.

3. The coverall according to claim 1, further comprising a fixation snap with attached and detached buttons on a corresponding position of the coverall when one end part of the opening-part fabric of the lower-clothes opening part and the opening part fabric are opened, the fixation snap being to fix a position of the opening part fabric.

4. The coverall according to claim 1, further comprising a wrist snap and an ankle snap provided with an end part of wrist side of the upper clothes part and an end part of ankle side of the lower clothes part to individually control a width thereof.

5. The coverall according to claim 1, wherein the luminous band is comprised of a back luminous band transversely coupled between the back fold parts arranged on both sides of back face of the upper clothes part, an arm luminous band formed wound round one side of both arms, and a leg luminous band formed wound round one side of both legs.

6. The coverall according to claim 1, wherein the upper clothes part further comprises chest pockets adapted in the right and left sides of the front face, the chest pockets having an internal space and being openable by a fastener, and a pen pocket adapted on an upper arm side, the pen pocket having two divided internal spaces into which writing materials can be inserted, and the lower clothes part further comprises lower-clothes pockets formed in the left and right sides of the opening part fabric of the lower clothes opening part, the lower-clothes pockets having an internal space.

7. The coverall according to claim 2, further comprising a fixation snap with attached and detached buttons on a corresponding position of the coverall when one end part of the opening-part fabric of the lower-clothes opening part and the opening part fabric are opened, the fixation snap being to fix a position of the opening part fabric.

8. The coverall according to claim 2, further comprising a wrist snap and an ankle snap provided with an end part of wrist side of the upper clothes part and an end part of ankle side of the lower clothes part to individually control a width thereof.

9. The coverall according to claim 2, wherein the luminous band is comprised of a back luminous band transversely coupled between the back fold parts arranged on both sides of back face of the upper clothes part, an arm luminous band formed wound round one side of both arms, and a leg luminous band formed wound round one side of both legs.

10. The coverall according to claim 2, wherein the upper clothes part further comprises chest pockets adapted in the right and left sides of the front face, the chest pockets having an internal space and being openable by a fastener, and a pen pocket adapted on an upper arm side, the pen pocket having two divided internal spaces into which writing materials can be inserted, and the lower clothes part further comprises lower-clothes pockets formed in the left and right sides of the opening part fabric of the lower clothes opening part, the lower-clothes pockets having an internal space.

* * * * *